US006382434B1

(12) United States Patent
Silberg

(10) Patent No.: US 6,382,434 B1
(45) Date of Patent: May 7, 2002

(54) COMPACT FOLDABLE MERCHANDISING DISPLAY RACK

(76) Inventor: Keith E. Silberg, 64 River Oaks Cir., Baltimore, MD (US) 21208

( * ) Notice: Subject to any disclaimer, the term of this patent is extended or adjusted under 35 U.S.C. 154(b) by 0 days.

(21) Appl. No.: 09/825,626

(22) Filed: Apr. 4, 2001

(51) Int. Cl.[7] ..... A47F 5/00
(52) U.S. Cl. ..... 211/195; 211/208; 211/204
(58) Field of Search ..... 211/195, 208, 211/207, 189, 182, 204, 206

(56) References Cited

U.S. PATENT DOCUMENTS

| | | | | | |
|---|---|---|---|---|---|
| 1,072,704 | A | | 9/1913 | Davis | |
| 1,453,644 | A | | 5/1923 | Tingle | |
| 2,260,294 | A | * | 10/1941 | Brown | |
| 3,063,571 | A | * | 11/1962 | Stempler | |
| 3,303,938 | A | | 2/1967 | Solomon | 211/182 |
| 3,533,513 | A | * | 10/1970 | Berman | |
| 3,722,702 | A | * | 3/1973 | Marker | |
| 3,921,814 | A | * | 11/1975 | Solomon | |
| 3,984,002 | A | * | 10/1976 | Howard | |
| 4,054,209 | A | * | 10/1977 | Solomon | 211/208 |
| 4,739,888 | A | | 4/1988 | Steiner | 211/198 |
| 4,946,050 | A | * | 8/1990 | Akopiantz | 211/189 X |
| 4,981,227 | A | * | 1/1991 | Ingram | 211/204 |
| 5,125,520 | A | * | 6/1992 | Kawasaki | |
| D333,741 | S | * | 3/1993 | Katz | |
| 5,370,248 | A | | 12/1994 | Robolin | 211/189 |
| 5,660,637 | A | * | 8/1997 | Dodge | |

* cited by examiner

*Primary Examiner*—Robert W. Gibson, Jr.
(74) *Attorney, Agent, or Firm*—Leonard Bloom; Robert M. Gamson

(57) ABSTRACT

A compact foldable merchandising display rack having a pair of rectangular frames pivotably connected to a horizontal support, one frame being on each side of the horizontal support. A pair of half-round frames are also pivotably connected to the horizontal support. Each half-round frame is nested within the confines of the respective rectangular frame. Each frame may be moved independently from a storage position in a vertical plane to an erected position in a horizontal plane. The rack is adjustable to a selected height. Each frame may be secured in the erected position. A plurality of the racks may be nested to reduce storage area.

9 Claims, 6 Drawing Sheets

COMPACT FOLDABLE MERCHANDISING DISPLAY RACK

BACKGROUND OF THE INVENTION

1. Field of the Invention

The present invention relates to a merchandising display rack and more particularly to a display rack for clothing which has foldable frames for holding garments and for ease of storage.

2. Description of Related Art

Racks for the display of merchandise such as garments have been known for a long time. A major difficulty with currently existing racks is the space required for storage of racks which are not displaying merchandise. Also, the need for space is exacerbated by the storage of both rectangular and circular display racks which are used for different types of displays depending on the specifics of the merchandise and the space available on the selling floor. Valuable warehouse space is used to store the rectangular and circular display racks.

U.S. Pat. No. 3,303,938 to Solomon discloses a nestable garment rack which assists in reduction of storage space required for display racks. However, it does not reduce storage of racks which have rectangular or circular frames on which the garments are hung. Robolin, in U.S. Pat. No. 5,370,248, discloses a garment rack with a pedestal base and extenders to which hanger rods are attached. The applicant is aware of U.S. Pat. No. 4,739,888 to Steiner which discloses a clothes drying apparatus which folds for reduced size in storage. The applicant is also aware of U.S. Pat. No. 1,072,704 to Davis and U.S. Pat. No. 1,453,644 to Tingle which disclose a display stand and a necktie holder respectively which have circular or semicircular frames.

However, none of these references disclose a display rack which has foldable rectangular and semicircular frames and a base which provide for greatly reduced storage requirements. Also, the references do not address the need for a display rack which can be easily and rapidly transitioned from a storage condition to a use condition and further wherein the use condition is convertible between rectangular, circular and mixed rectangular/circular.

BRIEF SUMMARY OF THE INVENTION

It is an object of the present invention to provide a compact folding merchandise display rack which can be stored in reduced space and is rapidly and easily changed from a storage mode to a use mode and vice versa.

In accordance with the teachings of the present invention, there is disclosed a compact foldable merchandising display rack having a base. The base has a Z configuration for nesting a plurality of racks, thereby further reducing the required floor space during storage. A pair of spaced-apart vertical supports are connected to the base, extending thereabove, and having respective top portions at a height above the base. A horizontal support is mounted on the respective top portions of the vertical supports. A pair of rectangular frames are pivotably connected to the horizontal support, one on each side thereof. Each rectangular frame has a first storage portion in which the respective frame is disposed in a vertical plane substantially adjacent to the pair of vertical supports, such that each respective frame may be pivotably moved independently of the other respective frame. Each rectangular frame has a second erected position in which the respective frame is disposed substantially in a horizontal plane. The pair of rectangular frames in the erected position together form a horizontal rack for display purposes. A pair of half-round frames are pivotably connected to the horizontal support; each half-round frame being nested within the confines of a respective rectangular frame. Each half-round frame may be moved independently of the other half-round frame from an initial storage position in which the respective half-round frame is disposed in a vertical plane substantially adjacent to the pair of vertical supports and into a second erected position in which each respective half-round frame is disposed in a horizontal plane. There is provided either a half-round or a substantially circular display in lieu of the rectangular rack for alternate display purposes. Thus, there is provided a versatile merchandising rack which can be quickly set up for either rectangular, circular, half-round or mixed half-round/rectangular displays, and which may be folded substantially flat, thereby reducing the required floor space during storage.

The vertical supports each have a pair of telescoping members. Means are provided for connecting the telescoping members to one another at selected increments wherein the height of the top portions may be adjusted to a desired height.

In further accordance with the teachings of the present invention, there is disclosed a compact foldable merchandising display rack, having a base, a pair of spaced-apart vertical supports connected to the base, extending thereabove, and having respective top portions at a height above the base. A horizontal support is mounted on the respective top portions of the vertical supports. A pair of rectangular frames are pivotably connected to the horizontal support, one on each side thereof. Each rectangular frame has a first storage portion in which the respective frame is disposed in a vertical plane substantially adjacent to the pair of vertical supports, such that each respective frame may be pivotably moved independently of the other respective frame. Each rectangular frame has a second erected position in which the respective frame is disposed substantially in a horizontal plane and is releasably latched to the horizontal support. The pair of rectangular frames in the erected position together form a horizontal rack for display purposes. The releasable latch is a hasp having a hinged first end connected to the respective frame. A second end of the hasp has a slotted opening formed therein. A rotatable key means is mounted on the horizontal support such that, in the erected position of the respective frame, the key means is received in the slotted opening of the hasp and rotation of the key means locks the key means in the slotted opening of the hasp. Thus, there is provided a versatile merchandising rack which can be quickly set up for either rectangular, or half-rectangular displays, and which may be folded substantially flat, thereby reducing the required floor space during storage.

In still further accordance with the teachings of the present invention, there is disclosed a compact foldable merchandising display rack, having a base, a pair of spaced-apart vertical supports connected to the base, extending thereabove, and having respective top portions at a height above the base. A horizontal support is mounted on the respective top portions of the vertical supports. A pair of half-round frames are pivotably connected to the horizontal support. Each half-round frame may be moved independently of the other half-round frame from an initial storage position in which the respective half-round frame is disposed in a vertical plane substantially adjacent to the pair of vertical supports and into a second erected position in which each respective half-round frame is disposed in a horizontal plane and is releasably latched to the horizontal support. There is provided either a half-round or a substantially circular display for alternate display purposes. The releasable latch is a hasp having a hinged first end connected to the respective frame. A second end of the hasp has a slotted opening formed therein. A rotatable key means is mounted on the horizontal support such that, in the erected position of the respective frame, the key means is received in the slotted opening of the hasp and rotation of the key means locks the key means in the slotted opening of the hasp. Thus, there is provided a versatile merchandising rack which can be quickly set up for either circular or half-round displays, and which may be folded substantially flat, thereby reducing the required floor space during storage.

These and other objects of the present invention will become apparent from a reading of the following specification taken in conjunction with the enclosed drawings.

BRIEF DESCRIPTION OF THE DRAWINGS

FIG. 2 shows several nested racks in a storage area.

FIG. 3 shows one rack being wheeled out of storage.

FIG. 4 shows the rectangular frames in the erected position and clothing placed on the rack for display.

FIG. 5 shows the clothing removed from the rack and one of the rectangular frames being folded to the storage position.

FIG. 6 shows both rectangular frames folded to the storage position and one of the half-round frames being raised to the erected position.

FIG. 7 shows both half-round frames in the erected position and clothing placed on the rack for display.

FIG. 8 shows the rack disposed against a wall with both rectangular frames and one of the half-round frames in the storage position with one of the half-round frames in the erected position.

FIG. 9 shows the rack with all of the frames in the storage positions.

FIG. 10 shows the rack of FIG. 9 wheeled back into a storage area.

FIG. 17 shows the hasp partially folded with the slotted opening in the hasp poised above the key means.

FIG. 18 shows the hasp fully extended with the key means received in the slotted opening in the hasp.

FIG. 19 shows the key means rotated through 90° to secure the key means in the slotted opening in the hasp.

DESCRIPTION OF THE PREFERRED EMBODIMENTS

Figure 1:
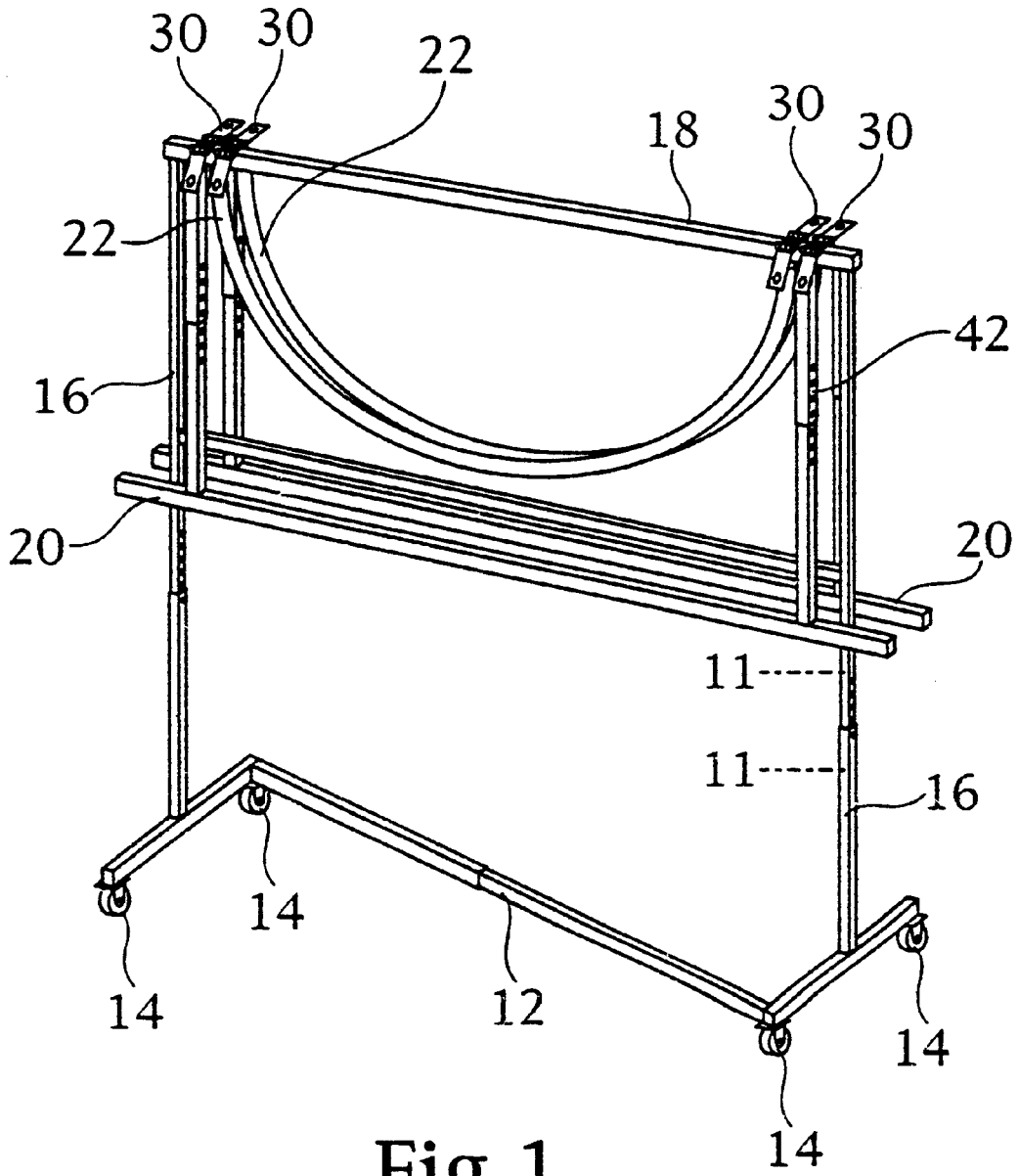
FIG. 1 is a perspective view of the rack of the present invention in a storage configuration.
Figure 4:
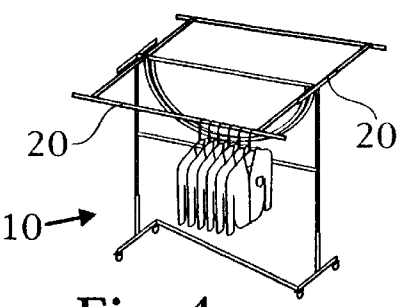
FIGS. 2–10 are a sequence of perspective views showing the storage and setting up of the rack of the present invention.
Figure 7:
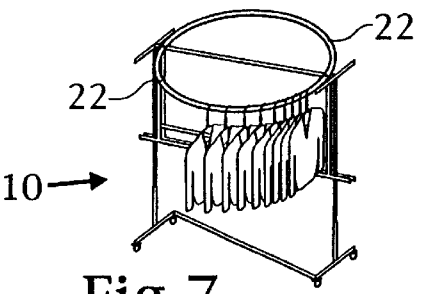

Referring now to FIG. 1, the rack 10 has a base 12 which preferably is provided with wheels, casters 14 or similar means to permit the rack to be rolled from one location to another. Connected to the base 12 are a pair of spaced-apart vertical supports 16. The top portions of the vertical supports extend a height above the base. A horizontal support 18 is mounted on the top portions of the vertical supports 16. A pair of rectangular frames 20 are pivotably mounted to the horizontal support 18 with one rectangular frame 20 on one side of the horizontal support 18 and the second rectangular frame 20 on the opposite side of the horizontal support 18. Each rectangular frame 20 has a first storage position as shown in FIG. 1 in which the respective rectangular frame 20 is disposed in a vertical plane substantially adjacent to the pair of vertical supports 16. Each rectangular frame 20 may be pivotably moved independently of the other rectangular frame 20 into a second erected position as will be described. In the second erected position, the respective rectangular frame 20 is disposed substantially in a horizontal plane and is releasably secured in the horizontal plane as will be described. In this manner, one or both of the rectangular frames 20 may be disposed in the second erected position to form a rack with merchandise hung on the erected rectangular frames 20 for display purposes.

A pair of half-round frames 22 are also pivotably connected to the horizontal support 18, with one half-round frame 22 on one side of the horizontal support 18 and the second half-round frame 22 on the other side of the horizontal support 18. Each half-round frame 22 is nested within the confines of the respective rectangular frame 20. Each half-round frame 22 also has a first storage position as shown in FIG. 1 wherein each half-round frame 22 is disposed in a vertical plane substantially adjacent to the pair of vertical supports 16 and in substantially the same vertical plane as the respective rectangular frame 20 on the same side of the horizontal support 18. Each half-round frame 22 may be pivotably moved independently of the other half-round frame 22 and independently of the rectangular frames 20, into a second erected position as will be described. In the second erected position, the respective half-round frame 22 is disposed substantially in a horizontal plane and is releasably secured in the horizontal support 18 as will be described.

In this manner, one or both of the half-round frames 22 may be disposed in the second erected position. Also, one of the half-round frames 22 and one of the rectangular frames 20 may each be disposed in the second erected position on opposite sides of the horizontal support 18 to form a single rack with merchandise hung for display purposes on the half-round frame 22 and on the rectangular frame 20.

Figure 10:
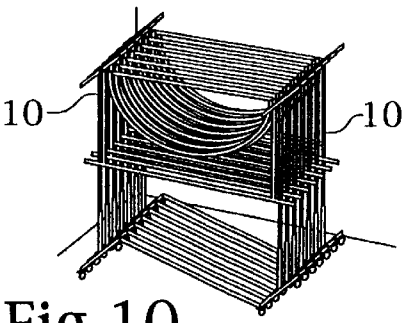
Figure 3:
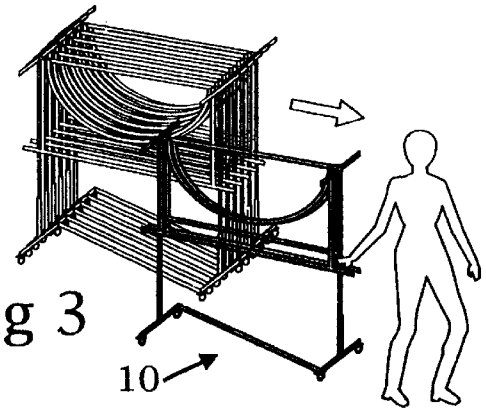
Figure 6:
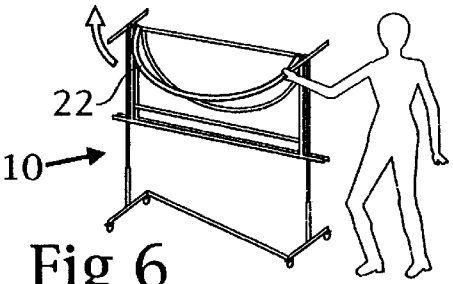
Figure 9:
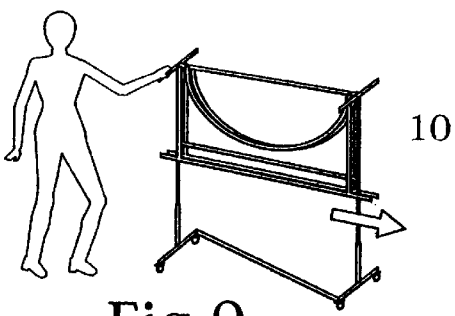
Figure 2:
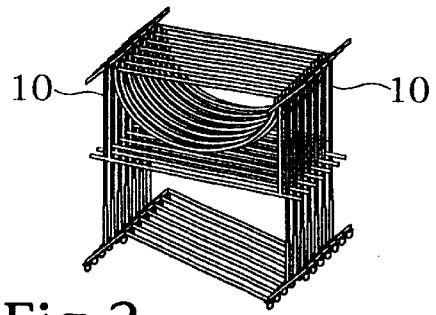
Figure 5:
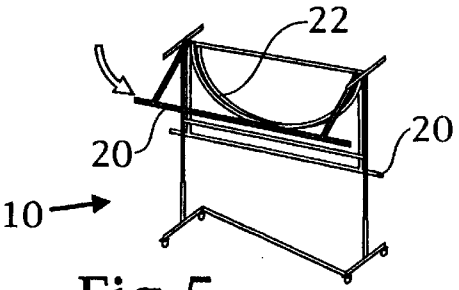
Figure 8:
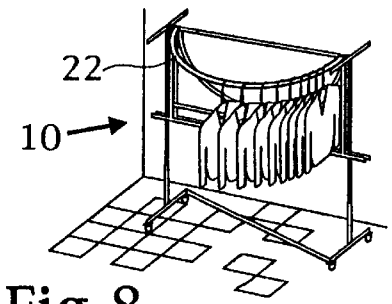

FIGS. 2–10 show the use of the rack 10 of the present invention. As can be seen in FIG. 2, the plurality of racks, all having the rectangular frames 20 and half-round frames 22 in the storage positions, are nested in minimum storage space because of the "Z" shaped bases 12 and the vertical disposition of the frames 20, 22. One of the racks 10 is removed from storage (FIG. 3) and wheeled to a selling floor location. At the selling floor location (FIG. 4), the rectangular frames 20 are disposed in the second erected positions and merchandise is hung from the frames 20. The merchandise is removed (FIG. 5) and the rectangular frames 20 are changed to the storage positions. One of the half-round frames 22 is raised to the second erected position (FIG. 6). Both of the half-round frames 22 are disposed in the second erected position (FIG. 7) and merchandise is placed on the rack 10. In an alternate use with the rack 10 located against a wall (FIG. 8), both rectangular frames 20 and the half-round frame 22 closest to the wall are in the storage position. The half-round frame 22 distal from the wall is in the second erected position and merchandise is placed on the half-round frame 22. All of the merchandise is removed from the rack and all frames 20, 22 are in the storage positions (FIG. 9). The rack 10 is wheeled back to the storage area (FIG. 10).

Figure 11:
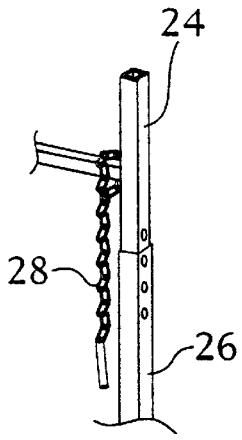
FIG. 11 is an enlarged perspective view taken across the lines 11—11 of FIG. 1 showing the telescoping vertical support.
Figure 12:
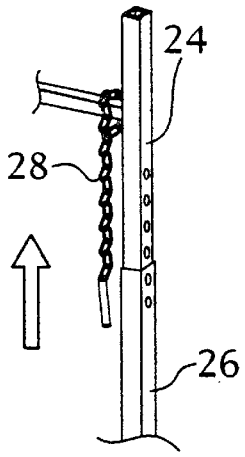
FIG. 12 shows the vertical support of FIG. 11 being extended.
Figure 13:
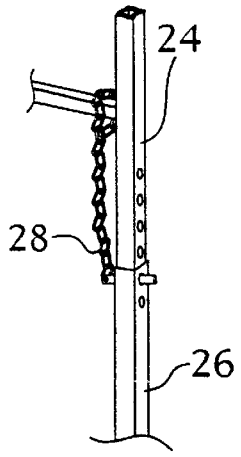
FIG. 13 shows a peg inserted into the extended vertical support of FIG. 12.
Figure 14:
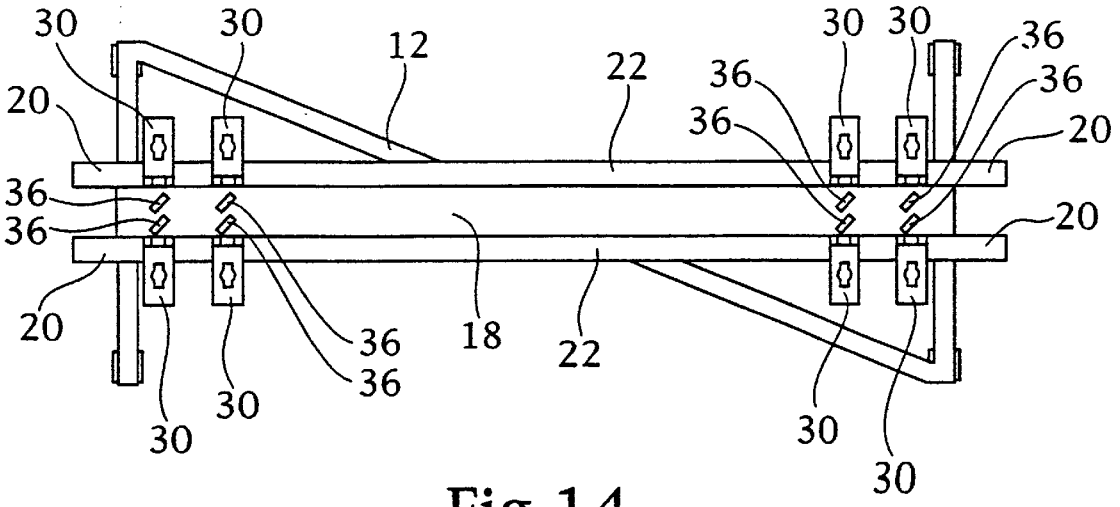
FIG. 14 is a top plan view of the rack of the present invention.
Figure 15:
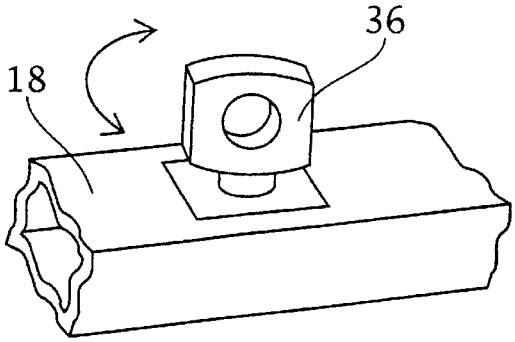
FIG. 15 is an enlarged perspective view of the rotatable key means on the horizontal support.
Figure 16:
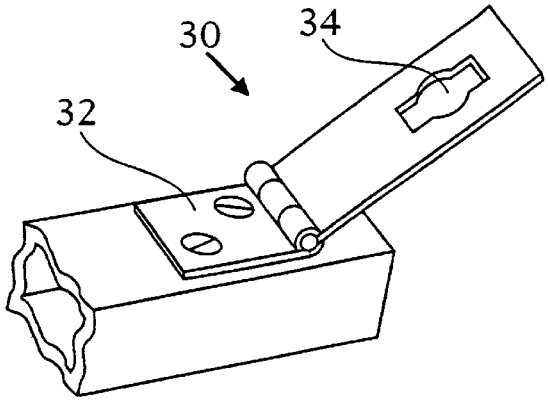
FIG. 16 is an enlarged perspective view of the hinged hasp mounted on a frame.
Figure 17:
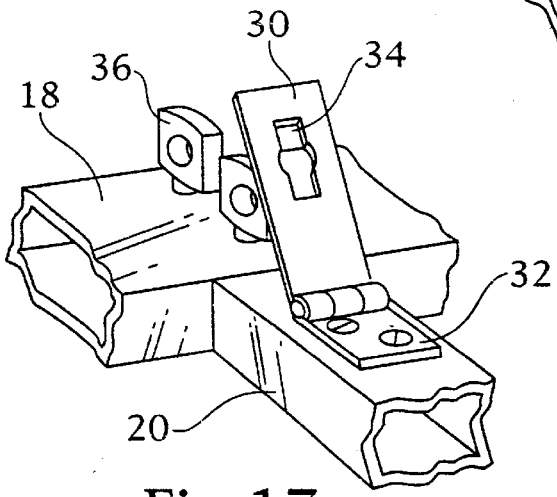
FIGS. 17–19 are a sequence of perspective views showing the latching of the frame to the horizontal support.
Figure 18:
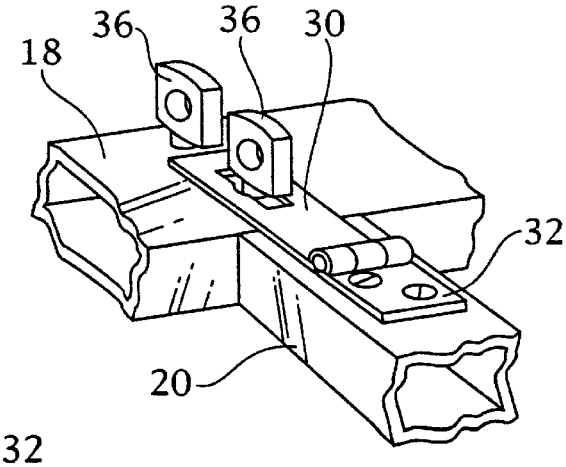
Figure 19:
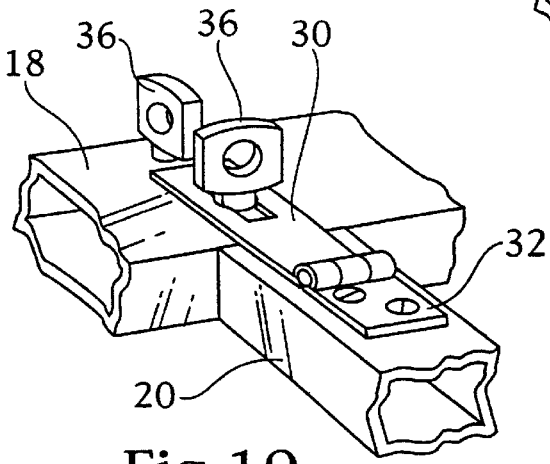
Figure 20:
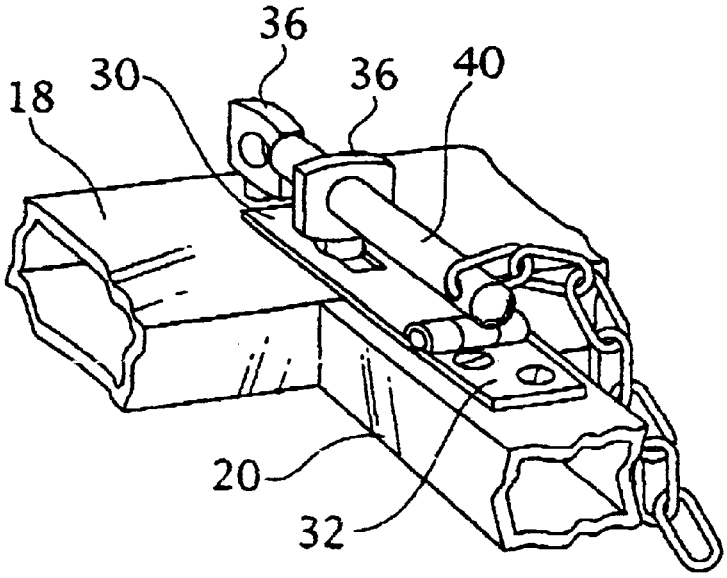
FIG. 20 shows a peg on a chain received in an opening in the key means as an additional safety feature.

As seen in FIGS. 11–13, the vertical supports 16 are formed of two telescoping members 24, 26. Means 28 are provided for adjustably connecting the telescoping members 24, 26 such that the vertical supports 16 may be shortened or lengthened to adjust the height of the top portions of the vertical support 16 to a desired height above the base 12. The means 28 may be a plurality of vertically aligned openings in one of the telescoping members and a detent in the other telescoping members such that the detent is engaged in a selected opening. The means 28 may be a plurality of aligned openings in both of the telescoping members 24, 26 with a pin connected to a chain removably disposed through a corresponding opening in each of the telescoping embers. Other means known to persons skilled in the art may be used to connect the telescoping members 24, 26 and the present invention is not limited to the means described above.

The frames 20, 22 must be secure in the horizontal plane in the second erected position to avoid collapse when the rack 10 is fully loaded with merchandise. In one embodiment (FIGS. 14–20), a hasp 30 having a hinged first end 32 is connected to the upper surface of the respective frames 20, 22 near the pivotal connection between the respective frame 20, 22 and the vertical support 16. A slotted opening 34 is formed in the second end of the hasp 30. A rotatable key means 36 is mounted on the horizontal support 18 projecting upwardly therefrom. With the frame 20, 22 in the second erected position, the second end of the hasp 30 is disposed so the rotatable key means 36 is received in the slotted opening 34. The key means 36 is rotated approximately 90° to lock the key means 36 in the slotted opening and secure the frame 20, 22 in the second erected position. Rotation of the key means 36 an additional 90°, or 90° in reverse, aligns the key means 36 with the slotted opening 34 so the second end of the hasp 30 may be disengaged from the key means 36. In this manner, the respective frame 20, 22 is releasably latched to the horizontal support 18. Alternately, the hasp 30 may be connected to the horizontal support 18 and the rotatable key means 36 may be mounted on the upper surface of the respective frames 20, 22. The rotatable key means 36 preferably has an opening 38 formed transversely therein. A peg 40 may be placed in the opening 38 to prevent the key means 36 from being disengaged from the slotted opening 34 in the hasp 30 such that a second positive lock is provided to secure the respective frame 20, 22 in the second erected position. The peg 40 may be connected to a chain which is anchored to the rack 10 to prevent loss of the peg 40.

Figure 23:
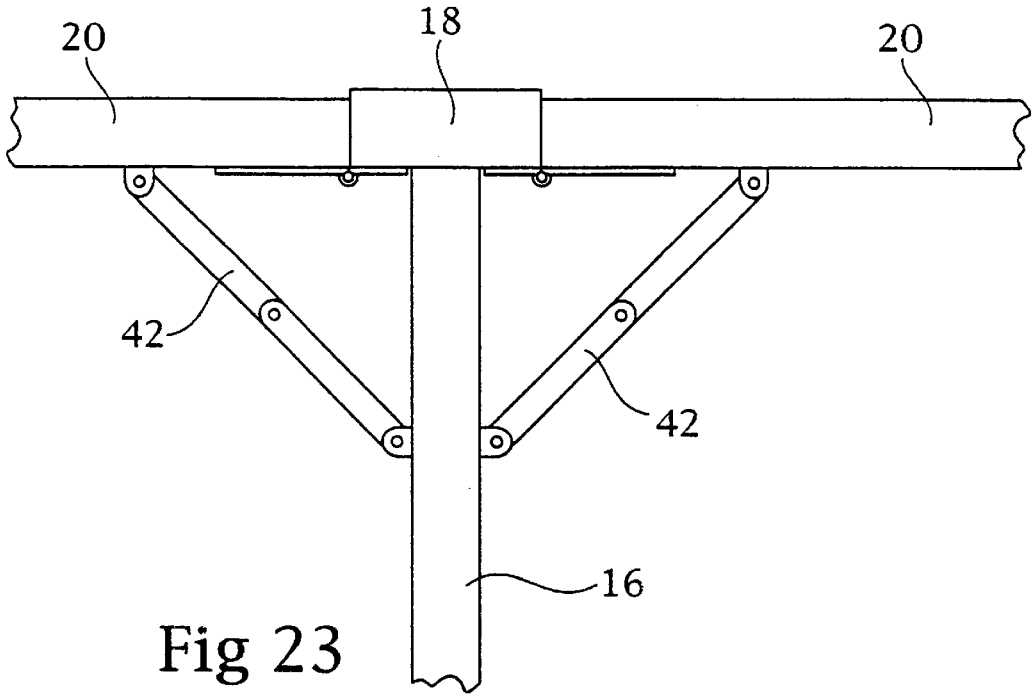
FIG. 23 is an enlarged end view of the rack showing an alternate embodiment to secure the frame in the second erect position.
Figure 24:
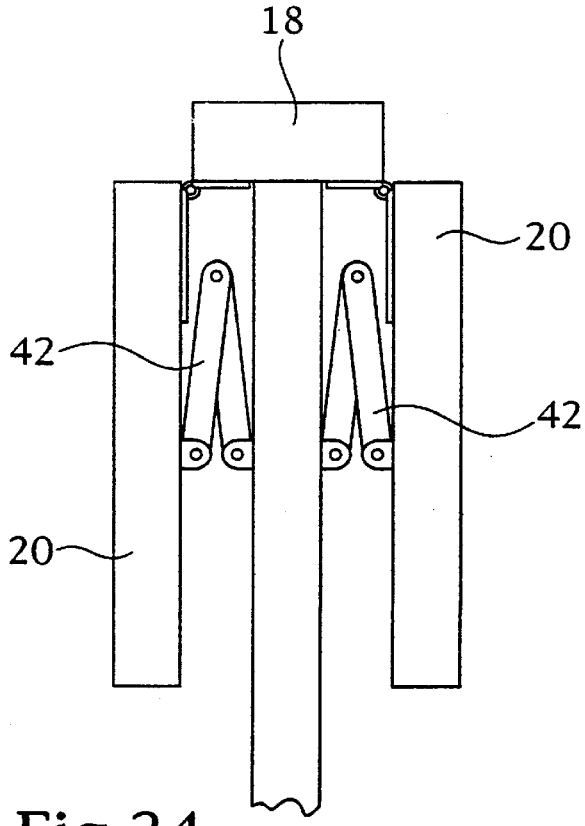
FIG. 24 is an enlarged end view of FIG. 20 showing the frame in the storage position.

In a second embodiment (FIGS. 23, 24), a foldable support means 42 has a first end pivotably connected to the lower surface of the respective frame 20, 22. The second end of the foldable support means 42 is pivotably connected to the vertical support 16. A gusset may be formed between the vertical support 16 and the horizontal support 18 to provide additional strength to the rack 10 and to serve as a portion of the vertical support 16 to which the second end of the foldable support means 42 is connected. An identical foldable support means 42 is provided for each arm of each respective rectangular frame 20 and half-round frame 22. When the foldable support means 42 is locked in an opened position (FIG. 23) the frame is secured in the second erected position. When the foldable support means 42 is folded in two at the juncture between the two ends, the frame is no longer supported and the frame is in the first storage position (FIG. 24).

Thus, the respective frames 20, 22 may be secured in the second erected position by support on either the top surface or the lower surface of the respective frames. The present invention is not limited to the embodiments described herein but other support and securing means known to persons skilled in the art may be used.

Figure 21:
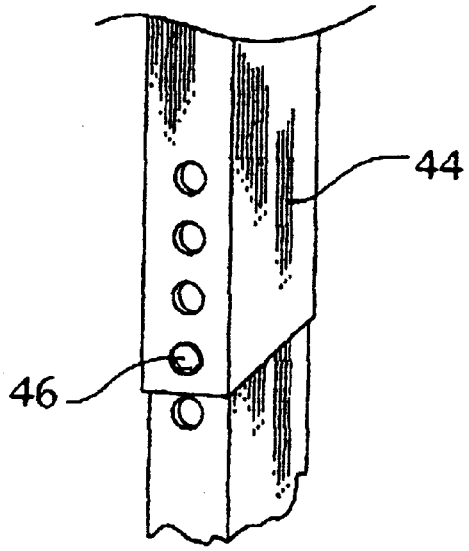
FIG. 21 is a perspective view of the telescoping members of the rectangular frame having a detent to engage the openings.
Figure 22:
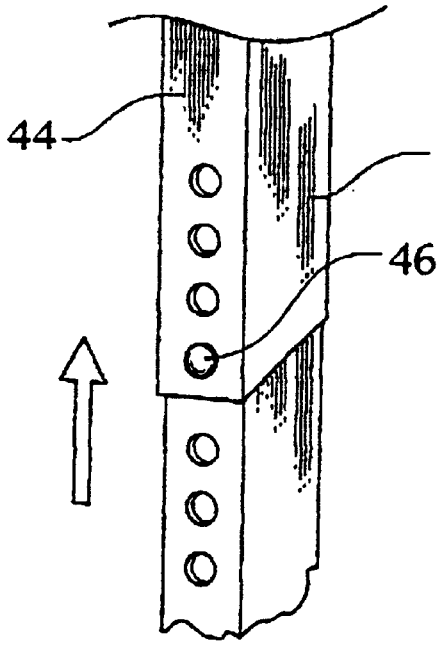
FIG. 22 is a view of FIG. 21 with the detent engaging a different opening.

The rectangular frame 20 has a length which is measured distally from the horizontal support 18. Preferably, the arms 44 of the rectangular frame 20 which are pivotably connected to the horizontal support 18 are telescoping (FIGS. 21–22). Adjusting means 46 are provided for adjustably connecting the telescoping portions of the arms 44 for lengthening or shortening the length of the arms 44 of the respective rectangular frame 20. The adjusting means 46 may be a plurality of vertically aligned openings in one of the telescoping members of the arm 44 and a detent in the other of the telescoping members of the arm 44. The detent is engaged in a selected opening. The adjusting means 46 may be a plurality of aligned openings in both of the telescoping members of the arm 44 with a pin removably disposed through a corresponding opening in each of the telescoping members. Other means known to persons skilled in the art may be used to connect the telescoping members of the arm 44 and the present invention is not limited to the adjusting means described above. Thus, the rectangular frames 20 may be expanded in length to provide an increased capacity to display merchandise.

Preferably, the wheels 14 on the base 12 have a locking means to prevent movement of the rack with merchandise on display.

In an alternate embodiment, the vertical support 16 is a single pedestal to the top of which the horizontal support 18 is mounted. The single pedestal may be connected to the Z-type base 12 at a midpoint of the cross member. Another alternate embodiment is a pedestal base with an enlarged X-shaped base. The X-shaped base can be nested with other X-shaped bases.

The merchandising display rack of the present invention provides a very versatile single display rack which can be made to be fully rectangular, half-rectangular, fully round, half-round and half-round/half-rectangular. The frames are foldable to a storage position which occupies much less space than racks which do not have foldable frames. The rack has an adjustable height to accommodate adult and childrens' merchandise. Each rectangular frame is adjustable in length to enable the display of more merchandise or to fit in a smaller floor space. The Z-shaped base is amenable to nesting to further economize on storage space in warehousing of racks. The racks can be changed from rectangular display to circular display without the need for tooling. The changes can be made rapidly to reduce manpower requirements for changing displays.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A compact foldable merchandising display rack, comprising a base; a pair of spaced-apart vertical supports connected to the base, extending thereabove, and having respective top portions at a height above the base; a horizontal support mounted on the respective top portions of the vertical supports; a pair of rectangular frames pivotably connected to the horizontal support, one on each side thereof, such that each rectangular frame has a first storage portion in which the respective frame is disposed in a vertical plane substantially adjacent to the pair of vertical supports, such that each respective frame may be pivotably moved independently of the other respective frame and into a second erected position in which the respective frame is disposed substantially in a horizontal plane, and such that the pair of rectangular frames in the erected position together form a horizontal rack for display purposes; and a pair of half-round frames pivotably connected to the horizontal support; each half-round frame being nested within the confines of a respective rectangular frame, such that each half-round frame may be moved independently of the other half-round frame from an initial storage position in which the respective half-round frame is disposed in a vertical plane substantially adjacent to the pair of vertical supports and into a second erected position in which each respective half-round frame is disposed in a horizontal plane, thereby providing either half-round or a substantially circular display in lieu of the rectangular rack for alternate display purposes, and thereby providing a versatile merchandising rack which can be quickly set up for either rectangular, circular, half-round or mixed half-round/rectangular displays, and which may be folded substantially flat, thereby reducing the required floor space during storage.

2. The compact foldable merchandising display rack of claim 1, wherein the base has a Z configuration for nesting a plurality of racks, thereby further reducing the required floor space during storage.

3. The compact foldable merchandising display rack of claim 1, further comprising the vertical supports each having a pair of telescoping members, means for adjustably connecting the telescoping members to one another at selected increments, wherein the height of the top portions above the base may be adjusted to a desired height.

4. The compact foldable merchandising display rack of claim 1, wherein each rectangular frame has a length measured distally from the horizontal support, each length being adjustable to a desired length.

5. The compact foldable merchandising display rack of claim 1, wherein a hasp having a hinged first end is connected to the respective frame, a second end of the hasp having a slotted opening formed therein, a rotatable key means being mounted on the horizontal support such that in the erected position of the respective frame, the key means is received in the slotted opening of the hasp, and rotation of the key means locks the key means in the slotted opening of the hasp such that the respective frame is releasably latched to the horizontal support and secured in the second erected position.

6. The compact foldable merchandising display rack of claim 1, further comprising a pair of support means, one support means disposed between the respective frame and each of the respective vertical supports adjacent to said frame, wherein the pair of support means secure the respective frame in the horizontal plane in the second erected position.

7. A compact foldable merchandising display rack, comprising a base; a pair of spaced-apart vertical supports connected to the base, extending thereabove, and having respective top portions at a height above the base; a horizontal support mounted on the respective top portions of the vertical supports; a pair of rectangular frames pivotably connected the horizontal support, one on each side thereof, such that each rectangular frame has a first storage portion in which the respective frame is disposed in a vertical plane substantially adjacent to the pair of vertical supports, such that each respective frame may be pivotably moved independently of the other respective frame and into a second erected position in which the respective frame is disposed substantially in a horizontal plane and is releasably latched to the horizontal support, and such that the pair of rectangular frames in the erected position together form a horizontal rack for display purposes; the releasable latch being a hasp having a hinged first end connected to the respective frame, a second end of the hasp having a slotted opening formed therein, a rotatable key means being mounted on the horizontal support such that, in the erected position of the respective frame, the key means is received in the slotted opening of the hasp and rotation of the key means locks the key means in the slotted opening of the hasp, and thereby providing a versatile merchandising rack which can be quickly set up for either rectangular or half-rectangular displays, and which may be folded substantially flat, thereby reducing the required floor space during storage.

8. A compact foldable merchandising display rack, comprising a base; a pair of spaced-apart vertical supports connected to the base, extending thereabove, and having respective top portions at a height above the base; a horizontal support mounted on the respective top portions of the vertical supports; and a pair of half-round frames pivotably connected to the horizontal support; such that each half-round frame may be moved independently of the other half-round frame from an initial storage position in which the respective half-round frame is disposed in a vertical plane substantially adjacent to the pair of vertical supports and into a second erected position in which each respective half-round frame is disposed in a horizontal plane and is releasably latched to the horizontal support, thereby providing either half-round or a substantially circular display for display purposes, the releasable latch being a hasp having a hinged first end connected to the respective frame, a second end of the hasp having a slotted opening formed therein, a rotatable key means being mounted on the horizontal support such that, in the erected position of the respective frame, the key means is received in the slotted opening of the hasp and rotation of the key means locks the key means in the slotted opening of the hasp, and thereby providing a versatile merchandising rack which can be quickly set up either circular or half-round displays, and which may be folded substantially flat, thereby reducing the required floor space during storage.

9. A compact foldable merchandising display rack, comprising a base, wherein the base has a Z configuration for nesting a plurality of racks, thereby further reducing the required floor space during storage; a pair of spaced-apart vertical supports connected to the base, extending thereabove, and having respective top portions at a height above the base, the vertical supports each having a pair of telescoping members, means for connecting the telescoping members to one another at selected increments wherein the height of the top portions may be adjusted to a desired height; a horizontal support mounted on the respective top portions of the vertical supports; a pair of rectangular frames pivotably connected to the horizontal support, one on each side thereof, such that each rectangular frame has a first storage portion in which the respective frame is disposed in a vertical plane substantially adjacent to the pair of vertical supports, such that each respective frame may be pivotably moved independently of the other respective frame and into a second erected position in which the respective frame is disposed substantially in a horizontal plane, and such that the pair of rectangular frames in the erected position together form a horizontal rack for display purposes; and a pair of half-round frames pivotably connected to the horizontal support; each half-round frame being nested within the confines of a respective rectangular frame, such that each half-round frame may be moved independently of the other half-round frame from an initial storage position in which the respective half-round frame is disposed in a vertical plane substantially adjacent to the pair of vertical supports and into a second erected position in which each respective half-round frame is disposed in a horizontal plane, thereby providing either half-round or a substantially circular display in lieu of the rectangular rack for alternate display purposes, and thereby providing a versatile merchandising rack which can be quickly set up for either rectangular, circular, half-round or mixed half-round/rectangular displays, and which may be folded substantially flat, thereby reducing the required floor space during storage.

* * * * *